United States Patent [19]

Kassai

[11] Patent Number: 4,723,813

[45] Date of Patent: Feb. 9, 1988

[54] TABLE ATTACHING CONSTRUCTION FOR NURSING CHAIRS

[75] Inventor: Kenzou Kassai, Osaka, Japan

[73] Assignee: Aprica Kassai Kabushikikaisha, Osaka, Japan

[21] Appl. No.: 893,479

[22] Filed: Aug. 5, 1986

[30] Foreign Application Priority Data

Aug. 14, 1985 [JP] Japan ..... 60-124694

[51] Int. Cl.[4] ..... A47B 83/02

[52] U.S. Cl. ..... 297/153; 292/30; 297/149

[58] Field of Search ..... 297/148, 149, 151, 153; 292/29, 30, 52, 53, 127, 221

[56] References Cited

U.S. PATENT DOCUMENTS

| | | | |
|---|---|---|---|
| 1,123,331 | 1/1915 | Loeber | 292/30 |
| 1,556,524 | 10/1925 | Kibble et al. | 292/127 |
| 1,766,366 | 6/1930 | Welch et al. | 292/127 X |
| 2,483,633 | 10/1949 | Froelich | 297/149 |
| 3,097,884 | 7/1963 | Alford | 297/153 |
| 3,649,074 | 3/1972 | McDonald | 297/153 |
| 4,105,247 | 8/1978 | Saint | 297/149 |
| 4,582,359 | 4/1986 | Wise et al. | 297/153 X |

FOREIGN PATENT DOCUMENTS

| | | | |
|---|---|---|---|
| 461807 | 12/1949 | Canada | 297/149 |
| 21331 | 5/1981 | Japan . | |

*Primary Examiner*—Kenneth J. Dorner
*Assistant Examiner*—Peter R. Brown
*Attorney, Agent, or Firm*—W. G. Fasse; D. H. Kane, Jr.

[57] ABSTRACT

A table attaching construction for nursing chairs has longitudinally extending right- and left-hand table support frames, a table disposed on these table support frames, and right- and left-hand operating levers. The right- and left-hand operating levers are adapted to be turned between first locking and second release positions. When the operating levers are each in the first position, they are in engagement with the outer lateral portions and lower portions of the table support frames. When the operating levers are each in the second position, such engagement is canceled. The table attaching construction for nursing chairs further includes right- and left-hand slide members, and springs for urging these slide members to slide inwardly. Each slide member has an opening for the associated operating lever to extend vertically therethrough. Under the action of the springs, the wall surfaces of the openings in the slide members press the operating levers to maintain the latter in the first locking position. If an operating lever provided on one side of the table is turned to the second position and then, in this state, if the table is pushed to move toward the other side, then the engagement between the pair of operating levers and the pair of table support frames is canceled and the table can be removed by one hand only.

7 Claims, 9 Drawing Figures

TABLE ATTACHING CONSTRUCTION FOR NURSING CHAIRS

FIELD OF THE INVENTION

This invention relates to a table for a nursing chair. When a baby is seated on the nursing chair, food or a toy is placed on the table for the baby to eat or to play with, respectively. More particularly, the invention relates to a construction for removably attaching a table to a nursing chair.

DESCRIPTION OF THE PRIOR ART

This type of table attaching construction is disclosed in Japanese Utility Model Publication No. 21331/1981. FIG. 9 is a sectional view of the table attaching construction for nursing chairs disclosed in said publication.

The table 1 is disposed on a pair of longitudinally extending lateral plates 2 on the right- and left-hand sides of a nursing chair. In the state shown in FIG. 9, an operating lever 3 is urged by the action of a cylindrical coil spring 4 toward the back of the table 1, with the fitting portion 3*a* of the operating lever 3 fitting on the lower surface of the rib 2*a* of the lateral plates 2. As a result, the operating lever 2 fixes the table 1 in position while embracing the rib 2*a*.

To remove the table 1 from the lateral plates 2 and out of the state shown, the user grips the right- and left-hand operating levers 3 with the hands and turns the right- and left-hand operating levers outwardly as shown in phantom lines in FIG. 9 against the forces of the cylindrical springs 4. And then, still holding the operating levers 3, the operator moves the table 1 upwardly, whereby the table 1 is separated from the nursing chair.

The table attaching construction described above requires both hands for removing the table 1 from the lateral plates 2. Therefore, if she is holding a child in one arm, it is impossible for her to remove the table, a fact which is inconvenient.

SUMMARY OF THE INVENTION

Accordingly, it is an object of the invention to provide a table attaching construction for nursing chairs which requires only one hand for removing the table.

A table attaching construction for nursing chairs according to the invention comprises longitudinally extending right- and left-hand table support frames on the right- and left-hand sides of a nursing chair, a table disposed on said right- and left-hand table support frames, and right- and left-hand operating levers on the right- and left-hand sides of said table.

The right- and left-hand operating levers are each adapted to be turned between first and second positions. When the right- and left-hand operating levers are both in the first position, they engage the outer lateral portions and lower portions of the right- and left-hand table support frames. Further, when the right- and left-hand operating levers are both in the second position, the aforesaid engagement is cancelled.

The present table attaching construction for nursing chairs further comprises right- and left-hand slide members transversely slidable in the table, and springs for urging the right- and left-hand slide members to slide inwardly. The right- and left-hand slide members each have an opening through which the associated operating lever extends vertically. Further, with the right- and left-hand slide members urged as described above, the wall surfaces of the openings in the right- and left-hand slide members press the right- and left-hand operating levers to maintain them in the first position.

Using one hand, the user grips one side of the table and also the operating lever disposed on one side of the table and turns said operating lever into the second position, whereby the engagement between the operating lever and the table support frame on one side is cancelled. In this state, the operator pushes the table toward the other side to move it in that direction, with the result that the engagement between the operating lever and the table support frame on the other side is cancelled.

As described above, according to the invention, the table can be removed by one hand, so that even if the user is holding a child in one arm, it is possible to remove the table. Further, since the right hand or the left hand may be used to perform the operation, the construction is very convenient in its use.

These objects and other objects, features, aspects and advantages of the present invention will become more apparent from the following detailed description of the present invention when taken in conjunction with the accompanying drawings.

DESCRIPTION OF PREFERRED EMBODIMENTS AND OF THE BEST MODE OF THE INVENTION

Figure 1:
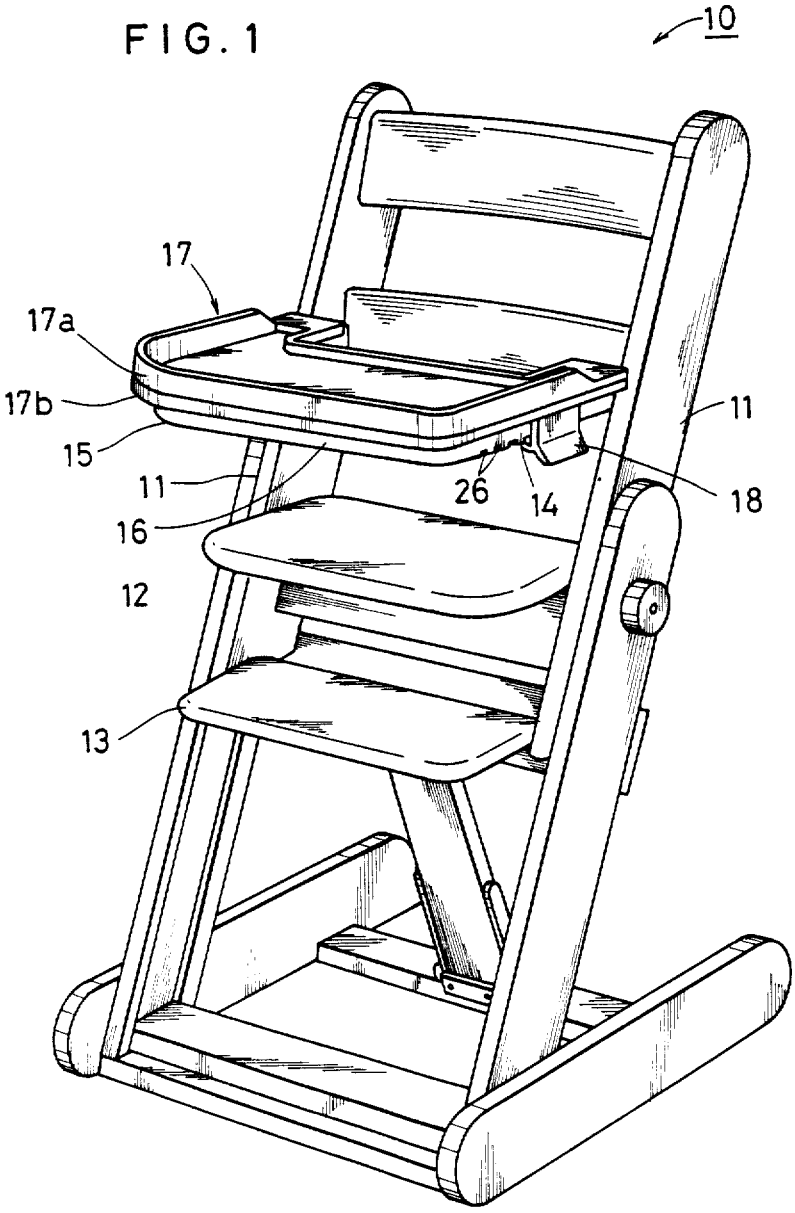
FIG. 1 is a perspective view of a high chair to which an embodiment of the invention is applied.

FIG. 1 is a perspective view of a high chair to which an embodiment of this invention is applied. The high chair 10 has a pair of vertically extending lateral frames 11 on its right- and left-hand sides. A seat member 12 forming a seat and a footrest 13 are installed between said lateral frames 11. Disposed above the seat member 12 are left- and right-hand table support frames 14 and 15 extending longitudinally on the left- and right-hand sides of the high chair 10. The left- and right-hand table support frames 14 and 15 are interconnected by a front table support frame 16. That is, the left- and right-hand table support frames 14 and 15 and the front table support frame 16 form an integral U-shaped frame. In this context the term "right-hand side" used in this specification refers to the right-hand side of a child sitting on the high chair 10, and the term "left-hand side" refers to the left-hand side of the child.

Figure 3:
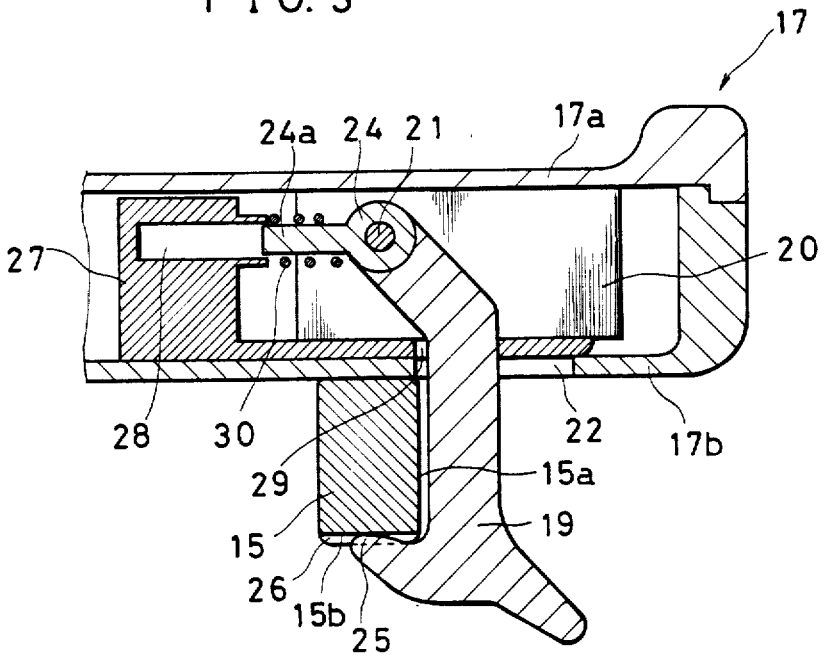
FIG. 3 is a view taken along the line III—III in FIG. 2.

As shown, a table 17 is disposed on the table support frames 14, 15 and 16. The table 17 comprises an upper table or top 17*a* disposed above and a lower table or bottom 17*b* disposed below, said upper and lower tables being joined together, for example, by a fit as shown in FIG. 3.

On opposite sides of the table, there are left- and right-hand operating levers 18 and 19. The right-hand operating lever 19 is hidden and not visible in FIG. 1. These left- and right-hand operating levers 18 and 19 are turnable between first and second positions. This will be described in more detail below.

Figure 2:
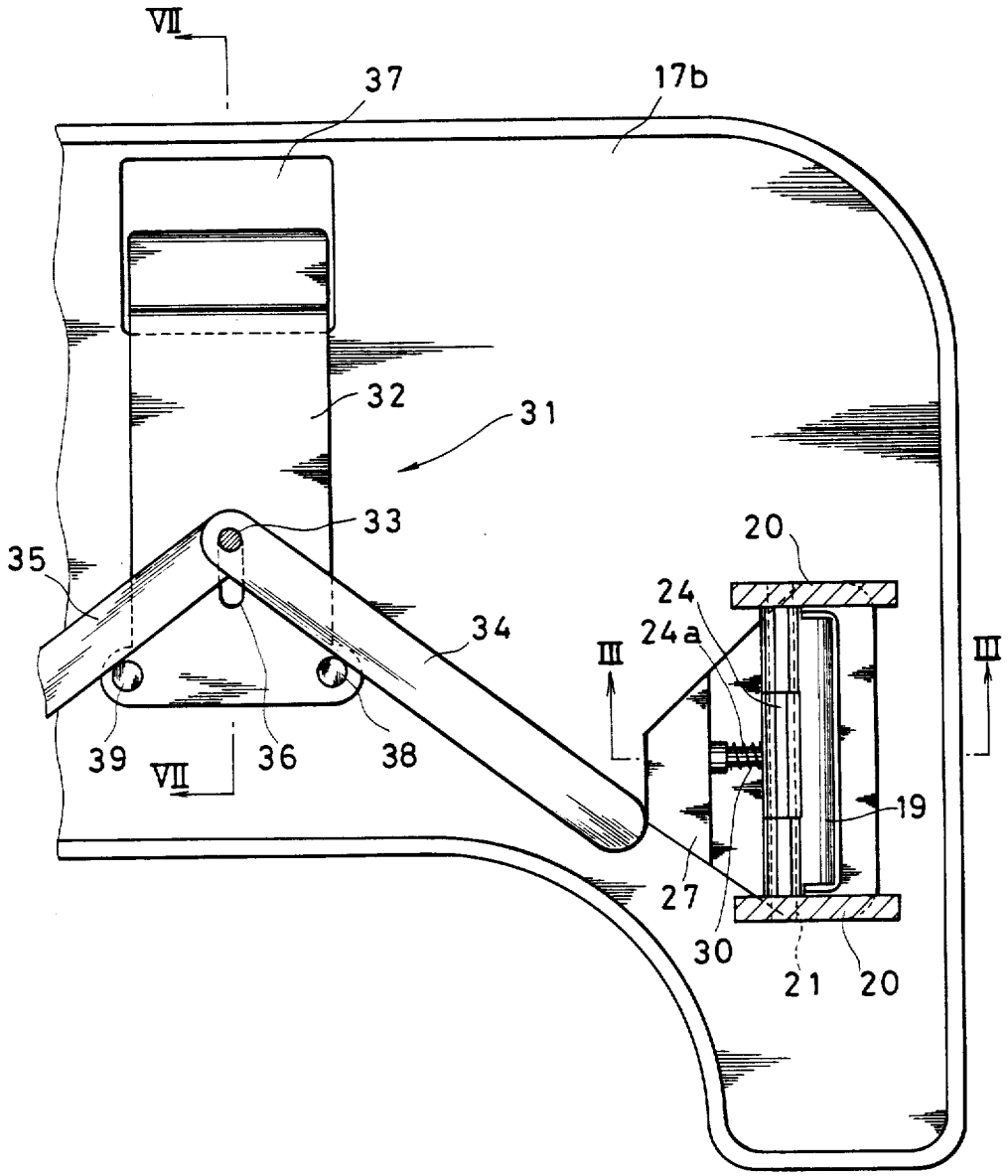
FIG. 2 is a plan view, partially broken away, against the bottom of a table shown in FIG. 1.

FIG. 2 is a plan view of the table shown in FIG. 1. For the sake of convenience, the table 17 is shown with the upper table 17*a* removed.

The construction for attaching the table 17 to the table support frames 14, 15 and 16 is installed in connection with the right-hand operating lever 19 positioned on the right-hand side of the high chair 10 and with the left-hand operating lever 18 positioned on the left-hand side of the high chair. Since the construction associated with the right-hand operating lever 19 is substantially the same as that associated with the left-hand operating lever 19, a description will be given below primarily of the construction associated with the right-hand operating lever 19.

As shown in FIGS. 2 and 3, a pair of support members 20 is fixed to the right-hand side of the upper table 17*a*. The members 20 extend downwardly toward the lower table 17*b*. The right-hand operating lever is turnably installed between said pair of support members 20 by a pin 21. The lower table 17*b*, as shown in FIG. 3, has an opening 22 through which the right-hand operating lever 19 extends. The right-hand operating lever 19 is shaped to embrace the right-hand table support frame 15. More particularly, as shown in FIG. 3, the lever 19 is shaped so that in the first position shown in FIG. 3, it engages the outer lateral portion 15*a* and the lower portion 15*b* of the right-hand table support frame 15.

Figure 4:
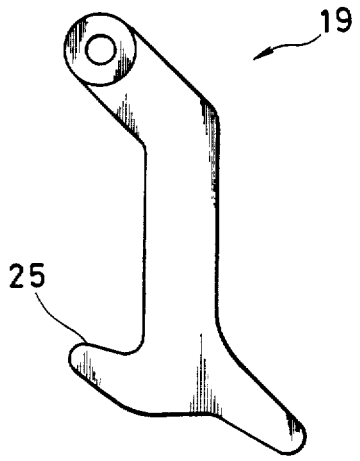
FIG. 4 is a rear view of a right-hand operating lever 19 shown in FIGS. 2 and 3.
Figure 5:
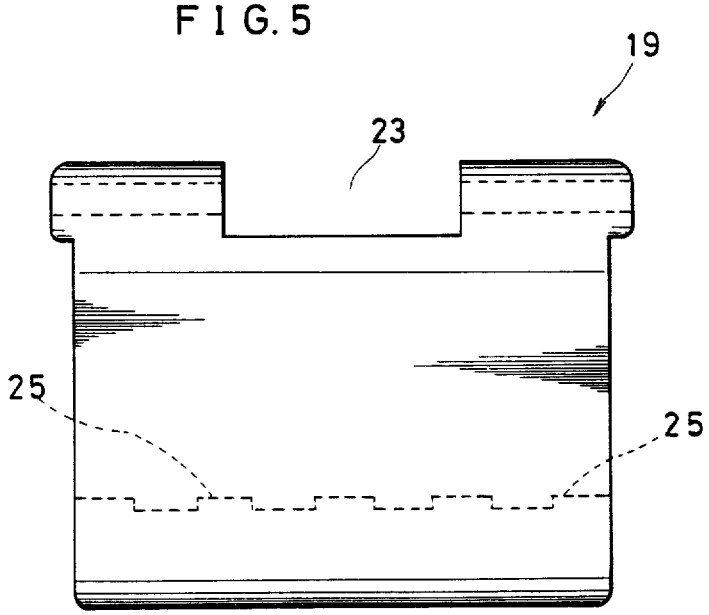
FIG. 5 is a right-hand side view of the right-hand operating lever 19.

Referring to FIGS. 4 and 5, the upper middle portion of the right-hand operating lever 19 has a recess 23 in which a substantially T-shaped spring holding member 24 is received as shown in FIG. 2. The pin 21 extending through the right-hand operating lever 19 extends also through the spring holding member 24 having an inward projection 24*a* facing inwardly.

Further, as shown in FIGS. 3 and 5, the portion of the right-hand operating lever 19 which is adapted to engage the lower portion 15*b* of the right-hand table support frame 15 has a plurality of engaging projections 25 arranged in the longitudinal direction. In association therewith, the lower portion 15*b* of the right-hand table support frame 15 has a plurality of engaging recesses 26 for engagement by said engaging projections 25. The engaging recesses 26 are shown in FIG. 1.

Figure 6:
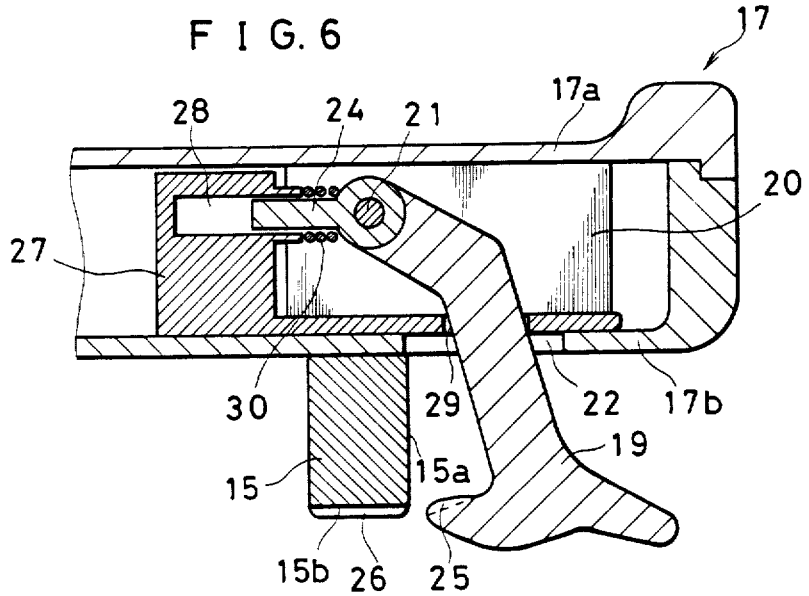
FIG. 6 is a sectional view similar to that of FIG. 3, but showing the state established when the right-hand operating lever has been turned out of the state shown in FIG. 3.

When the engaging projections 25 on the left- and right-hand operating levers 18 and 19 are in engagement with the engaging recesses 26 of the left- and right-hand table support frames 14 and 15, respectively, the table 17 is firmly fixed in position. On the other hand, as shown in FIG. 6, when the right- and left-hand operating levers 19 and 18 are turned to the position shown in FIG. 2, the engagement between the engaging projections 25 and the engaging recesses 26 is cancelled, whereby the table 17 can be moved on the table support frames 14, 15 and 16. After the table 17 has been moved to a suitable position, the table 17 can be fixed in that position by engaging the engaging projections on the left- and right-hand levers 18 and 19 with the engaging recesses 26 of the table support frames 14 and 15.

Referring to FIGS. 2 and 3, the left- and right-hand sides of the table 17 are provided with left- and right-hand slide members 27 adapted for sliding in the transverse direction. Both sliding members 27 have a reception hole 28 for receiving the inward projection 24*a* of the spring holding member 24 for guiding the respective slide member. Further, the right-hand slide member 27 has an opening 29 through which the right-hand operating lever 19 extends.

As shown in FIGS. 2 and 3, a spring 30 is mounted on the inward projection 24*a* of the spring holding member 24, whereby the right-hand slide member 27 is constantly urged inwardly. Thus, in the normal state, the wall surface of the opening 29 in the right-hand operating lever 19 presses the right-hand operating lever 19 to maintain the latter in the first position shown in FIG. 3.

The arrangement of the right-hand operating lever 19 described above is equally provided for the left-hand operating lever 18 located on the left-hand side of the table 17. Therefore, if the left- and right-hand operating levers 18 and 19 provided on the right- and left-hand sides of the table 17 are turned to the second position shown in FIG. 6, the engagement between the right- and left-hand operating levers 18 and 19 and the right- and left-hand table support frames 14 and 15 is canceled. In this state the table 17 can be lifted upwardly for its complete removal.

In the above description, the table 17 has been removed by using both hands. However, it is also possible to remove the table 17 by using but one hand. For example, suppose that the left-hand operating lever 18 alone has been turned to the second position. In that case, the right-hand operating lever 19 has not been touched by any hand. As a result, the right-hand operating lever 19 remains in the second position. If the table 17 is pushed to the right by the hand which is now gripping both the left-hand side of the table 17 and the left-hand operating lever 18, then the right-hand operating lever 19 is pressed by the wall surface of the opening 29 in the right-hand slide member 27 or the wall surface of the opening in the lower table 17*b*, whereby it is moved to the right together with the table 17. As a result, the engagement between the engaging projections 25 on the right-hand operating lever 19 and the engaging recesses 26 of the right-hand table support frame 15 is canceled, enabling the table 17 to be removed. Similarly, the table 17 can be removed solely by the hand which is used to turn the right-hand operating lever 19. In this manner, the table can be removed either by right hand or by the left hand alone.

Figure 7:
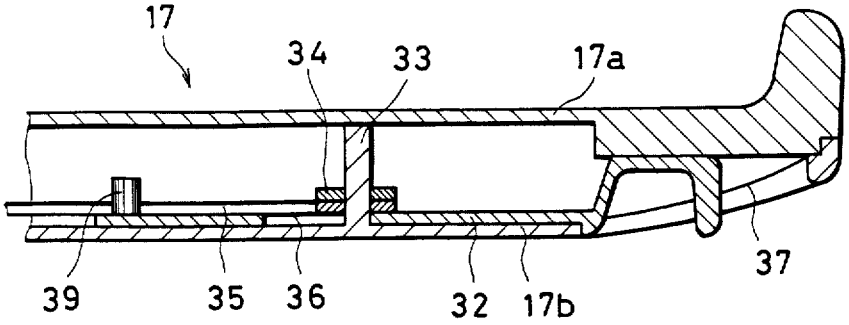
FIG. 7 is a view taken along the line VII—VII in FIG. 2.
Figure 9:
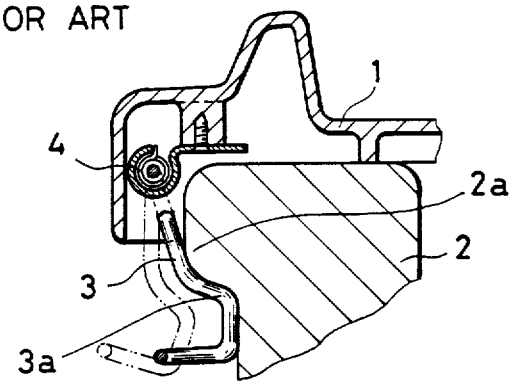
FIG. 9 PRIOR ART
FIG. 9 is a sectional view showing a conventional table attaching construction for nursing chairs shown in Japanese Utility Model Publication No. 21331/1981.

Referring to FIG. 2, slide member operating means 31 are disposed on the lower table 17*b* for simultaneously sliding outwardly the right-hand slide member 27 and left-hand slide member. Referring also to FIG. 7 showing a figure taken along the line VII—VII in FIG. 2, the slide member operating means 31 includes an operating button 32 adapted for sliding longitudinally in the table 17, a shaft 33 erected on the lower table 17*b*, and left- and right-hand pressing rods 34 and 35 adapted to be displaced in response to a sliding movement of the operating button 32. The operating button 32 has a longitudinally elongated opening 36 for receiving the shaft 33. Therefore, the operating button 32 is capable of sliding in the longitudinal direction within the range defined by an allowable relative movement between the shaft 33 and the elongated opening 36.

Substantially the middle of the front portion of the lower table 17*b* has a window 37. The front portion of the operating button 32 has a substantially inverted U-shape, as shown in FIG. 7. The inverted U-shaped portion is located in a position corresponding to the window 37. Therefore, it is possible to operate the operating button 32 for sliding movement by gripping the inverted U-shaped portion of the operating button 32 from below the table 17.

Figure 8:
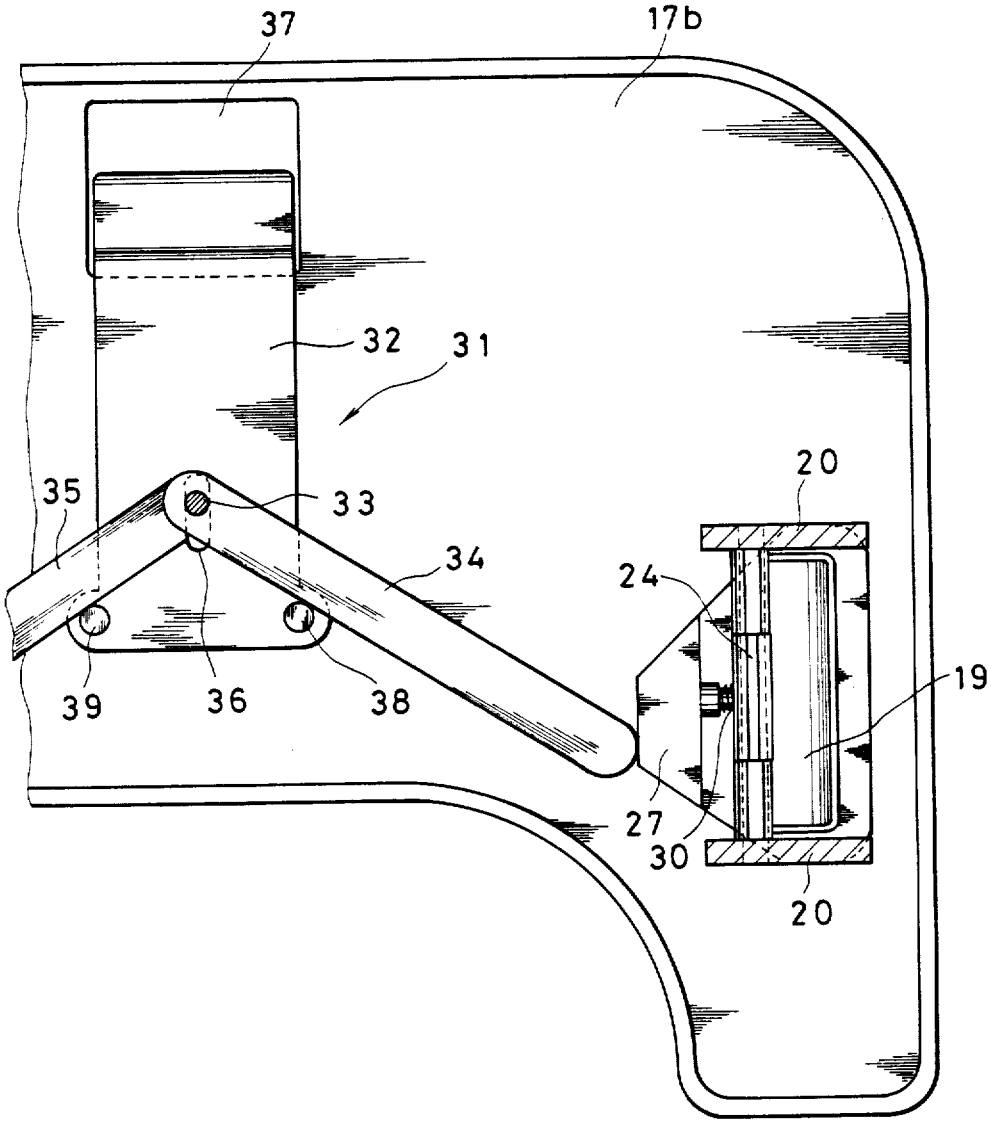
FIG. 8 is a view showing the state established when an operating button is pulled forward from the state shown in FIG. 2.

Referring to FIG. 2, the right- and left-hand pressing rods 34 and 35 are turnably connected at one of their respective ends to the shaft 33 and adapted to abut at the other ends thereof against the right-hand slide member 27 and against the left-hand slide member. Projecting pins 38 and 39 project from the operating button 32. These pins 38, 39 abut against the right- and left-hand pressing rods 34, 35 when the operating button 32 is operated to slide forward for turning these rods around the axis of the shaft 33. In this manner, as shown in FIG. 8, when the operating button 32 is operated by one hand to slide forward the right- and left-hand pressing rods 34 and 35 pressed by the projecting pins 38 and 39, are turned around the axis of the shaft 33, whereby the right-hand slide member 27 and the left-hand slide member slide outwardly. As a result, the engagement between the right-hand slide member 27 and left-hand slide member and the right- and left-hand table support frames 15 and 14 is canceled, enabling the removal of the table 17.

According to the embodiment shown in FIGS. 1 to 8, if either the left-hand operating lever 18 or the right-hand operating lever 19 or the operating button 32 is operated by one hand, the table 17 can be removed from the high chair 10. That is, it is possible for the user to remove the table 17 by the right hand alone or by the left hand alone. Further, since the position where such operation for removal is to be performed may be at the left-hand side or the right-hand side or the middle of the table 17, the table can be removed very easily and conveniently regardless of the relative position of the person to the high chair.

The embodiment described above and shown in the drawings is only an example in which the invention is embodied. Thus, various modifications and changes are possible. For example, as to the slide member operating means for simultaneously sliding the left- and right-hand slide member outwardly, various forms are possible. In this connection, it is to be noted that, since the left- and right-hand slide members are arranged to slide in the same plane, the installation of slide member operating means in the form of simple mechanisms, becomes easy. However, since the object of the invention is to provide a table attaching construction for removing the table by one hand, it is not absolutely necessary to provide slide member operating means. That is, the table can be removed by one hand without such slide member operating means.

Further, in the embodiment described above, the position of the table has been adjustable in the longitudinal direction; however, such longitudinal adjustment can be dispensed with. In that case, the aforesaid engaging projection 25 and the engaging recesses 26 are unnecessary.

In the embodiment described above, the invention has been applied to a high chair; however, the invention is not limited to a high chair but is applicable to nursing chairs, in general, including low chairs.

Although the present invention has been described and illustrated in detail, it is clearly understood that the same is by way of illustration and example only and is not to be taken by way of limitation, the scope of the present invention being limited only by the terms of the appended claims.

What is claimed is:

1. A table attaching construction for nursing chairs, comprising a table tray, longitudinally extending left- and right-hand table support frames (14, 15) on the left- and right-hand sides of a nursing chair, said table tray (17) being disposed on said left- and right-hand table support frames (14, 15), left- and right-hand operating levers (18, 19), journal means (21) pivotally mounting said operating levers on the right- and left-hand sides of said table tray respectively, said operating levers being turnable between first locking positions and second release positions, said left- and right-hand operating levers (18, 19) being in engagement with the outer lateral portions and lower portions of the left- and right-hand table support frames when they are each in said first locking position, said engagement being cancelled when said left- and right-hand operating levers are each in the second release position, a left-hand slide member and a right-hand slide member (27) slidably arranged in said table (17), each slide member (27) having an opening (29) below said journal means (21), each operating lever (18, 19) passing through its respective opening in abutting engagement with its respective slide member for actuation of said left- and right-hand operating levers (18, 19) by the respective slide member, springs (30) arranged for urging said left-hand slide member and said right-hand slide member (27) into a locking position, whereby said abutting engagement of the wall surfaces of said openings (29) in said left- and right-hand slide members (27) with the respective operating lever normally maintains said left- and right-hand operating levers (18, 19) in said first locked position, and permits moving said operating levers into said second release position, said construction further comprising slide member operating means (31) for simultaneously sliding said left- and right-hand slide members outwardly into said release position, whereby the wall surfaces of the opening (29) in said left- and right-hand slide members turn said left- and right-hand operating levers (18, 19) into said second release position, and wherein said slide member operating means (31) comprise an operating button (32) slidably mounted in said table (17), and left- and right-hand pressing rods (35, 34) adapted to be displaced in response to a sliding movement of said operating button for pressing said left- and right-hand slide members outwardly, said journal means connecting said operating levers to said table tray in such a position that manually releasing one of said left-hand and right-hand operating levers (18, 19) individually permits sliding the other operating lever out of said locking position by a respective movement of said tray held in one hand, said operating button (32) individually releasing both operating levers simultaneously for the removal of said table with one hand only.

2. The table attaching construction for nursing chairs as set forth in claim 1, wherein the position of said table (17) disposed on said left- and right-hand table support frames (14, 15) is longitudinally adjustable.

3. The table attaching construction for nursing chairs as set forth in claim 1, wherein said left- and right-hand slide members and the lower portions of said left- and right-hand table support frames (14, 15) are adapted to engage with each other by a combination of engaging recesses (26) and engaging projections (25).

4. The table attaching construction for nursing chairs as set forth in claim 1, wherein said slide member operating means (31) further comprise a shaft (33), said left- and right-hand pressing rods (34, 35) being turnably connected at one of their respective ends to said shaft (33) and adapted to abut at the other ends thereof against said left- and right-hand slide members, said operating button (32) having a longitudinally elongated opening (36) for receiving said shaft (33), and projections (38, 39) which, when said operating button (32) is operated for a sliding movement, abut against said left- and right-hand pressing rods (34, 35) for turning said pressing rods around said shaft (33).

5. A table attaching construction for nursing chairs comprising longitudinally extending left- and right-hand table support frames (14, 15) on the left- and right-hand sides of a nursing chair, a table (17) disposed on said left- and right-hand table support frames (14, 15) left- and right-hand operating levers (18, 19) pivotally mounted on the right- and left-hand sides of said table and turnable between first locking positions and second release positions, said left- and right-hand operating levers (18, 19) being in engagement with the outer lateral portions and lower portions of the left- and right-hand table support frames when they are each in said first locking position, said engagement being canceled when said left- and right-hand operating levers are each in the second release position, a left-hand slide member and a right-hand slide member (27) slidably arranged in said table (17) and having openings for said left- and right-hand operating levers (18, 19) to extend vertically therethrough, springs (30) arranged for urging said left-hand slide member and said right-hand slide member (27) into a locking position, whereby the wall surfaces of said openings in said left- and right-hand slide members (27) normally maintain said left- and right-hand operating levers (18, 19) in said first locked position, said construction further comprising slide member operating means (31) for simultaneously sliding said left- and right hand slide members outwardly, whereby the wall surfaces of the opening in said left- and right-hand slide members turn said left- and right-hand operating levers (18, 19) into said second release position, and wherein said slide member operating means (31) comprise an operating button (32) slidably mounted in said table (17), and left- and right-hand pressing rods (35, 34) adapted to be displaced in repsonse to a sliding movement of said operating button for pressing said left- and right-hand slide members outwardly, said construction being such that each of said left-hand and right-hand operating levers (18, 19) individually and said operating button (32) individually enables the removal of said table with one hand only, and wherein said slide member operating means (31) comprise a shaft (33), said left- and right-hand pressing rods (34, 35) being turnably connected at one of their respective ends to said shaft (33) and adapted to abut at the other ends thereof against said left- and right-hand slide members, said operating button (32) having a longitudinally elongated opening (36) for receiving said shaft (33), and projections (38, 39) which, when said operating button (32) is operated for a sliding movement, abut against said left- and right-hand pressing rods (34, 35) for turning said pressing rods around said shaft (33).

6. A nursing chair and table construction comprising a nursing chair including longitudinally extending left- and right-hand table support frames (14, 15) on the left- and right-hand sides of said nursing chair, a table tray (17) disposed on said left- and right-hand table support frames (14, 15), said table having a table top with two lateral right and left short edges and with two longitudinal edges, left- and right-hand operating levers (18, 19), journal means (21) pivotally mounting said operating levers substantially along said lateral short edges and below said table top of said table in such positions that any one of said operating levers can be squeezed and said table can be held simultaneously by one hand alone, said operating levers being turnable between first locking positions and second release positions by squeezing the fingers of said one hand toward the thumb, said left- and right-hand operating levers (18, 19) having engagement members (25) in engagement with outer lateral portions and lower portions of the left- and right-hand table support frames when each engagement member is in said first locking position, said engagement members facing toward each other so that said engagement of both engagement members are disengaged when only one of said left- and right-hand operating levers (18, 19) is squeezed upwardly and said table is lifted at said one operating lever and simultaneously said table is pushed in a direction parallel to said longitudinal edges for also disengaging the engagement member of the other operating lever (18 or 19), a left-hand slide member and a right-hand slide member (27) slidably arranged in said table (17), each of said slide members having openings (29) below said journal means (21), each operating lever (18, 19) passing through its respective opening in abutting engagement with its respective slide member for actuation of said left- and right-hand operating levers (18, 19) by the respective slide member, and springs (30) arranged for urging said left-hand slide member and said right-hand slide member (27) into a locking position, whereby said abutting engagement of the wall surfaces of said openings (29) in said left- and right-hand slide members (27) with the respective operating lever normally maintains said left- and right-hand operating levers (18, 19) in said first locking position and permits moving said operating levers into said second release position.

7. The nursing chair and table construction of claim 8, wherein said table top has an upwardly extending edge at least opposite said operating levers (18, 19) so that said operating levers (18, 19) and said upwardly extending edge together form a handle for simultaneously holding said table and operating one of said operating levers with one hand only.

* * * * *

UNITED STATES PATENT AND TRADEMARK OFFICE

CERTIFICATE OF CORRECTION

PATENT NO. : 4,723,813

DATED : February 9, 1988

INVENTOR(S) : Kenzou Kassai

It is certified that error appears in the above-identified patent and that said Letters Patent is hereby corrected as shown below:

Claim 5, (column 7, line 22), after "(14, 15)" insert --,--.

Claim 7, (column 8, line 54), replace "claim 8," by --claim 6,--.

Signed and Sealed this

Twenty-first Day of June, 1988

*Attest:*

*Attesting Officer*

DONALD J. QUIGG

*Commissioner of Patents and Trademarks*